US005243059A

United States Patent [19]

Ibuki et al.

[11] Patent Number: 5,243,059

[45] Date of Patent: Sep. 7, 1993

[54] PROCESS FOR PREPARING REFINED PALM OIL

[75] Inventors: Masahisa Ibuki; Masahisa Miyabe, both of Sennan; Yoshitaka Ebihara, Sakai, all of Japan

[73] Assignee: Fuji Oil Company, Limited, Osaka, Japan

[21] Appl. No.: 785,757

[22] Filed: Oct. 31, 1991

[30] Foreign Application Priority Data

Nov. 19, 1990 [JP] Japan ..... 2-314976

[51] Int. Cl.[5] ..... C11B 3/10

[52] U.S. Cl. ..... 554/191

[58] Field of Search ..... 260/428; 554/191

[56] References Cited

PUBLICATIONS

Kheak et al, JAOCS, vol. 59, No. 3, 1982, pp. 129-131.

*Primary Examiner*—José G. Dees
*Assistant Examiner*—Deborah D. Carr
*Attorney, Agent, or Firm*—Wenderoth, Lind & Ponack

[57] ABSTRACT

There is disclosed a process for preparing refined palm oil by treating a fat or oil containing palm oil as a main ingredient with an activated clay having 250 to 350 $m^2/g$ of a specific surface area and containing 0 to 3% by weight of ferric oxide and 70 to 90% by weight of silicon oxide. According to the process of the present invention, refined palm oil which hardly causes browning even upon heating and color reversion can be obtained.

4 Claims, No Drawings

PROCESS FOR PREPARING REFINED PALM OIL

FIELD OF THE INVENTION

The present invention relates to a process for preparing refined palm oil suitable for cooking.

BACKGROUND OF THE INVENTION

In order to use palm oil for food, usually, palm oil is refined by subjecting it to degumming, deacidification, decolorization and deodorization. In general, refined palm oil is estimated as an oil having excellent stability to oxidation. However, refined palm oil has a problem that, when it is used for cooking, for example, fries or the like, browning is quickly taken place (color reversion) and is not faded. That is, some of users complain that color reversion is deterioration of quality. And, since food obtained by cooking with color reversed palm oil becomes brownish, some of products are decreased their commercial value.

On the other hand, flavor of color reversed palm oil and cooked food using it have hardly changed. Therefore, there are hitherto few reports of studies on improvement of color reversion. For example, J.A.O.C.S., Vol. 59, No. 3 (March 1982) 129-131 reports a relation between acidity of an activated clay as a decolorizing agent and capability of decolorizing palm oil. However, this decolorization capability is intended to improve a color tone of refined oil itself and not to improve color reversion upon using it for cooking afterwards. According to a result of the present inventors' study, any relation between acidity of an activated clay and color reversion has been hardly observed.

OBJECTS OF THE INVENTION

The main object of the present invention is to provide a process for preparing refined palm oil which hardly causes browning even by heating and has little nature of color reversion.

This object as well as other objects and advantages of the present invention will become apparent to those skilled in the art from the following description.

SUMMARY OF THE INVENTION

In view of the tendency that highly improved taste for food is required, the present inventors have considered that improvement of color reversion of palm oil becomes an important theme and have made various studies of a process for preparing refined palm oil with improved properties in color reversion. As a result, the present inventors have found that, among steps relating to refining of palm oil, the decolorization step is important and, in particular, when palm oil is treated with a specific activated clay, it dose not cause browning even upon heat-cooking.

That is, the present invention provides a process for preparing refined palm oil which comprises treating a fat or oil containing palm oil as a main ingredient with an activated clay having 250 to 350 $m^2/g$ of a specific surface area and containing 0 to 3% by weight of ferric oxide and 70 to 90% by weight of silicon oxide.

According to the process of the present invention, refined palm oil which hardly causes browning even upon heating and color reversion can be obtained.

DETAILED DESCRIPTION OF THE INVENTION

In the present invention, palm oil is refined according to conventional methods, for example, by harvesting palm oil from palm pulp, degumming, deacidifying with alkali refining, physical refining or the like, and decolorizing it.

Palm oil can be harvested by pressing method or extracting method. In the case of using palm pulp containing much oil, it is preferable to harvest palm oil by pressing method. Palm oil can be obtained according to pressing method crushing palm pulp from which impurities have been removed, if necessary, steaming it in a steaming can, and pressing the crushed material with a conventional press. As extracting solvents used in extracting method, there are, for example, aliphatic hydrocarbons such as hexane and the like; aromatic hydrocarbons such as benzene, toluene, xylene and the like; alicyclic hydrocarbons such as cyclohexane and the like; halogenated hydrocarbons such as carbon tetrachloride, trichloroethylene, dichloroethane and the like; alcohols; ketones such as acetone, methyl ethyl ketone and the like; ethers such as diethyl ether, tetrahydrofuran and the like; esters such as ethyl acetate and the like; petroleum benzine; and the like. These solvents may be used alone or in combination thereof.

Usually, the above-described degumming treatment can be carried out by introducing warm water or steam in the harvested palm oil and separating lecithin, proteins, saccharides and other viscous materials as a slurry.

The above-described alkali refining treatment can be carried out by removing an acid component such as free fatty acids as an alkali metal salt. Examples of the alkali metals include sodium, potassium and the like. Normally, the alkali is used in the form of an aqueous solution.

The fat or oil subjected to the above-described decolorizing treatment may be that containing palm oil as a main ingredient. Examples of the fat or oil include palm oil alone, palm fractionated oil, palm interesterified oil, hydrogenated palm oil, or a mixture thereof with one or more other oils such as rapeseed oil, soybean oil and the like. The above-described fractionated oil can be obtained by a method using an organic solvent such as hexane and acetone, a method using an aqueous solution of a surfactant, dry fractionating method, molecular distillation method or the like. The interesterified oil can be obtained by subjecting palm oil together with a fat or oil other than palm oil, a fatty acid or a lower alkyl ester of fatty acid to an interesterification reaction using an alcoholate such as sodium methylate or the like, or an interesterification reaction using lipase or lipase preparation having 1,3-positions selectivity.

In the present invention, the fat or oil is treated with an activated clay having 250 to 350 $m^2/g$, preferably 250 to 300 $m^2/g$ of a specific surface area and containing 0 to 3% by weight, preferably 1.5 to 2.5 % by weight of ferric oxide and 70 to 90% by weight, preferably 75 to 85% by weight of silicon oxide. When the specific surface area and the content of ferric oxide and silicone oxide are out of the above range, improvement of color reversion of palm oil can hardly be expected. For example, when the specific surface area of the activated clay is less than 250 $m^2/g$, the color tone of refined palm oil is not good, and remarkable browning is caused by heating. When the specific surface area exceeds 350 $m^2/g$, the structure of montmorillonite which is the main component of the activated clay is liable to break and adsorbability which is the intrinsic function of a decolorizing agent is decreased. Therefore, the resultant refined palm oil tends to show severe browning and its flavor is deteriorated.

Although details of the function of the specific activated clay used in the present invention is not clear, the function is presumed to be due to the fact that an unknown material which promotes browning is specifically adsorbed and removed by the activated clay used in the present invention. This is probably resulted from the difference in micro pore size, shape and composition of micro pore and the like between the activated clay used in the present invention and a conventional one.

The activated clay can be used alone as the decolorizing agent or in combination with an adsorbent such as other activated clay, activated carbon, silica powder or the like. When the above specific activated clay is used with an adsorbent as the decolorizing agent, a high ability of decolorization can be obtained even if the amount of the activated clay is small and refined palm oil which hardly cause browning and color reversion can be obtained. The content of the activated clay having the above properties is usually not less than 3% by weight, preferably 5 to 100% by weight based on the total amount of the decolorizing agent to be used. When the content of the above activated clay is less than 3% by weight, the degree of browning of the resulting refined palm oil due to heating becomes greater.

Since the amount of the decolorizing agent including the specific activated clay varies depending upon a particular kind of the fat or oil to be used, it can not be determined uniformly and can be selected from a wide range. However, the amount of the decolorizing agent is usually 0.5 to 5 parts by weight, preferably 1 to 3 parts by weight, more preferably 1.5 to 2.5 parts by weight per 100 parts by weight of the fat or oil. When the amount of the decolorizing agent including the specific activated clay is less than 0.5 part by weight per 100 parts by weight of the fat or oil, the effect of decolorization is liable to be lowered. On the other hand, when the amount exceeds 5 parts by weight, the separation of the activated clay becomes complicated.

The decolorization treatment can be carried out according to a conventional method, for example, by adding the decolorizing agent including the specific activated clay to the above fat or oil, heating the mixture with stirring at a temperature of about 80° to 120° C., preferably about 105° to 110° C. for 15 to 60 minutes under reduced pressure, cooling the mixture to about 50° to 80° C., filtering the mixture with a filter press or the like to separate the fat or oil from the decolorizing agent.

Optionally, after the decolorization treatment, the decolorized oil may be subjected to a dewaxing treatment and a deodorizing treatment. The dewaxing treatment can be carried out by cooling the decolorized oil to, for example, 3° to 5° C., filtering the deposited solid fat or oil with a filter press or the like. The deodorizing treatment can be carried out by blowing superheated steam, $CO_2$ gas, nitrogen or the like into the fat or oil under reduced pressure. Preferably, the deodorizing treatment is carried out by heating the fat or oil to, for example, 230° to 250° C. under high vacuum and blowing superheated steam into it.

The refined palm oil obtained by the present invention can be used for cooking, for example, fry oil and the like.

The following Examples and Comparative Examples further illustrate the present invention in detail but are not to be construed to limit the scope thereof. All the "parts" are by weight unless otherwise stated.

EXAMPLES 1 AND 2 AND COMPARATIVE EXAMPLES 1 TO 6

Palm pulp was pressed and the resultant was subjected to conventional degumming treatment and alkali refining treatment to obtain palm oil. To the palm oil (100 parts) was added an activated clay (2.5 parts) shown in Table 1, and the mixture was subjected to decolorization treatment at a temperature of 110° C. for 10 minutes under vacuum. Then, the mixture was filtered and subjected to a conventional deodorization treatment with steam.

Properties of color reversion of the resultant refined palm oil were evaluated as follows:

The refined palm oil (500 g) was placed in a stainless beaker and distilled water was added to the oil through a stainless tube at a rate of 25 g/min., while heating to 190° C. A sample was collected. Intensity of red color of the sample was measured by a colorimeter, Rovibond® TINT MODEL E, using a Rovibond 5¼ inch cell.

Intensity of red color at 12 hours after addition of water and heating is shown in Table 1 together with properties of the activated clay. Red color intensity of each sample of the refined palm oil before the test was within the range of 1.0±0.1.

TABLE 1

| | Properties of activated clay | | | |
|---|---|---|---|---|
| Example No. | Specific surface area ($m^2/g$) | $SiO_2$ content (wt. %) | $Fe_2O_3$ content (wt. %) | Red color intensity |
| Ex. 1 | 283 | 79.8 | 1.9 | 7.1 |
| Ex. 2 | 255 | 78.3 | 2.3 | 7.5 |
| Comp. Ex. 1 | 280 | 65.0 | 2.3 | 14.2 |
| Comp. Ex. 2 | 293 | 92.4 | 2.8 | 15.3 |
| Comp. Ex. 3 | 400 | 72.4 | 2.6 | 15.2 |
| Comp. Ex. 4 | 200 | 76.8 | 2.4 | 12.0 |
| Comp. Ex. 5 | 292 | 86.3 | 5.9 | 13.0 |
| Comp. Ex. 6 | 175 | 61.5 | 6.0 | 14.1 |

As seen from Table 1, the refined palm oils of Examples 1 and 2 which were treated with the activated clay having the specific properties as defined in the present invention have lower intensity of red color and remarkably improved color reversion.

EXAMPLES 3 TO 6 AND COMPARATIVE EXAMPLES 7 AND 8

According to the same manner as that described above, intensity of red color at 18 hours after addition of water and heating was examined by using the activated clay in Example 1 and the activated clay in Comparative Example 6 in the ratio as shown in Table 2.

The results are shown in Table 2.

TABLE 2

| Example No. | Activated clay of Ex. 1 (wt. %) | Activated clay of Comp. Ex. 6 (wt. %) | Red color intensity |
|---|---|---|---|
| Comp. Ex. 7 | 1 | 99 | 13.9 |
| Comp. Ex. 8 | 2 | 98 | 13.0 |
| Ex. 3 | 5 | 95 | 7.8 |
| Ex. 4 | 20 | 80 | 7.5 |
| Ex. 5 | 50 | 50 | 7.9 |

TABLE 2-continued

| Example No. | Activated clay of Ex. 1 (wt. %) | Activated clay of Comp. Ex. 6 (wt. %) | Red color intensity |
|---|---|---|---|
| Ex. 6 | 90 | 10 | 8.0 |

As seen from Table 2, the refined palm oils of Examples 3 to 6 which were treated with the decolorizing agent containing 5 to 95% by weight of the activated clay used in Example 1 have lower intensity of red color and remarkably improved color reversion.

What is claimed is:

1. A process for preparing refined palm oil which comprises treating a fat or oil containing palm oil as a main ingredient with an activated clay having 250 to 350 $m^2/g$ of a specific surface area and containing 1.5 to 3% by weight of ferric oxide and 70 to 90% by weight of silicon oxide.

2. A process according to claim 1, wherein the fat or oil is treated with a decolorizing agent containing not less than 3% by weight of the activated clay.

3. A process according to claim 2, where the decolorizing agent is used in an amount of 0.5 to 5 parts by weight per 100 parts by weight of the fat or oil.

4. A process according to claim 1, wherein the treatment is carried out with stirring under reduced pressure at 80° to 120° C. for 15 to 60 minutes.

* * * * *